US006465741B2

(12) United States Patent
Pionek et al.

(10) Patent No.: US 6,465,741 B2
(45) Date of Patent: Oct. 15, 2002

(54) SPACER APPARATUS FOR HIGH VOLTAGE LEAD

(75) Inventors: Jason Christopher Pionek, Temecula, CA (US); Trentiss Tyrone Agnew, San Diego, CA (US); Randy Hiroshi Nakamura, San Diego, CA (US)

(73) Assignees: Sony Corporation (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/987,751

(22) Filed: Nov. 15, 2001

(65) Prior Publication Data

US 2002/0104680 A1 Aug. 8, 2002

Related U.S. Application Data

(60) Provisional application No. 60/267,651, filed on Feb. 8, 2001.

(51) Int. Cl.[7] ..... H01B 17/16

(52) U.S. Cl. ..... 174/174; 174/156; 174/168; 248/74.1; 248/74.2; 333/244

(58) Field of Search ..... 174/72 A, 138 G, 174/156, 166 S, 167, 168, 171, 174, 175; 248/56, 74.1, 74.2, 74.3; 333/242, 244

(56) References Cited

U.S. PATENT DOCUMENTS 3,092,360 A * 6/1963 Cook et al. ..... 174/153 G
3,271,506 A * 9/1966 Marin et al. ..... 333/244
3,286,015 A * 11/1966 Hildebrand et al. ..... 333/244
3,521,332 A * 7/1970 Kramer ..... 248/74.2
3,889,909 A * 6/1975 Koscik ..... 248/56
4,555,589 A * 11/1985 Osada ..... 174/156
4,715,571 A * 12/1987 Soltow et al. ..... 174/146
5,243,138 A * 9/1993 Guthke et al. ..... 174/138 R
5,510,579 A * 4/1996 Hammer et al. ..... 174/135
5,790,002 A * 8/1998 Fischer et al. ..... 174/174
5,790,003 A * 8/1998 Fischer et al. ..... 174/174
6,325,340 B1 * 12/2001 Yonezawa ..... 174/138 G

* cited by examiner

*Primary Examiner*—Dean A. Reichard
*Assistant Examiner*—Adolfo Nino
(74) *Attorney, Agent, or Firm*—Rader, Fishman & Grauer, PLLC; Ronald P. Kananen, Esq.

(57) ABSTRACT

A spacer apparatus (10) for spacing a high voltage lead (25) from other components in an electrical device includes a hub (11), a plurality of spokes (15–18) extending radially outwardly from the hub (11), and first and second spacer rim segments (19, 20) connected to the spokes (15–18). The hub (11) has a center (12) and first and second holes (13, 14) located on opposite sides of the center (12). The holes (13, 14) each have an open side for receiving a lead (25). The spacer rim segments (19, 20) are movable using a scissors-like action with the hub center (12) as a fulcrum to selectively enlarge one of the open sides to facilitate attachment to a high voltage lead (25). The spacer apparatus (10) is symmetrical so that an operator can attach the spacer to a lead (25) regardless of the direction in which the apparatus is initially grasped.

20 Claims, 3 Drawing Sheets

SPACER APPARATUS FOR HIGH VOLTAGE LEAD

This application claims the benefit of provisional application No. 60/267,651 filed on Feb. 8, 2001.

BACKGROUND OF THE INVENTION

1. Field of the Invention

The present invention relates generally to devices for spacing a wire or set of wires away from other components in electrical equipment. In particular, the present invention relates to an apparatus for spacing a high voltage lead from other components in a television, computer display monitor, projection screen, or other electrical equipment.

2. Description of the Related Art

High voltage lead spacers are commonly used to space a wire or set of wires away from other components in electrical equipment, such as televisions, computer monitors, projection screens, and so forth. Such spacers are necessary to maintain a predetermined minimal spacing between the high voltage leads and the other components. For example, safety guidelines for assembling the wiring of a computer monitor may require a spacing between the high voltage lead and the other components of at least one millimeter (mm) per peak kilovolt (kV) carried by the high voltage lead (e.g., 34 peak kV requires 34 mm spacing).

Existing spacers for high voltage leads are difficult to use, prone to assembly mistakes, and sometimes create safety concerns in the electrical equipment. The existing spacers are often difficult to attach to the high voltage lead.

Moreover, existing spacers typically have two areas in which the lead can be placed, a small diameter hole for 40 kV leads (approximately 4.2 mm diameter), and a large diameter hole for 50 kV leads (approximately 5.2 mm diameter). Due to the difficulty of use, 40 kV leads are sometimes placed into the 50 kV holes. This leads to the spacer sliding down the lead and can allow the lead to touch other components, causing a safety concern.

Accordingly, an improved high voltage spacer apparatus is needed.

SUMMARY OF THE INVENTION

It is an object of the present invention to provide an improved apparatus for spacing a high voltage lead from other components in electrical equipment that solves the problems with the prior art described above.

It is a further object of the present invention to provide a high voltage lead spacer apparatus that can be installed easily, that can be attached to the high voltage lead with a reduced force, and that is symmetrical to prevent misuse.

It is a further object of the present invention to provide an apparatus for spacing a wire from other electrical components which is economical to manufacture, efficient in use, capable of a long operating life, and particularly well adapted for spacing high voltage leads from other electrical components in a television, computer display monitor, projection screen, or other electrical equipment.

According to the present invention, a spacer apparatus is provided for spacing a high voltage lead from other components in an electrical device. The spacer apparatus includes a hub, a plurality of spokes extending radially outwardly from the hub, and first and second spacer rim segments connected to the spokes. The hub has a center and first and second holes located on opposite sides of the center. The holes each have an open side for receiving a high voltage lead. The spacer rim segments are movable using a scissors-like action with the hub center as a fulcrum to selectively enlarge one of the open sides to facilitate attachment to a high voltage lead. The spacer apparatus is symmetrical so that an operator can attach the spacer to a high voltage lead regardless of the direction in which the apparatus is initially grasped.

According to a broad aspect of the present invention, an apparatus for spacing a high voltage lead from other components in an electrical device is provided, comprising: a hub having a center and first and second holes located on opposite sides of the center, the holes each having an open side facing away from the center for receiving a high voltage lead; first and second pairs of spokes extending radially outwardly from the respective open sides of the first and second holes of the hub; and first and second spacer rim segments connected to outer ends of the spokes and defining a generally disk-shaped spacer structure concentric with the center of the hub, the first and second spacer rim segments being movable relative to each other to deform the hub center and selectively enlarge one of the open sides to facilitate attachment to a high voltage lead.

According to another broad aspect of the present invention, an insulative spacer apparatus is provided, comprising: a central hub portion having an axis of symmetry and first and second cable holders positioned on opposite sides of the axis, the cable holders each having an open side facing away from the axis; a plurality of spokes extending radially outwardly from the central hub portion; and first and second spacer rim segments connected to outer ends of the spokes and defining a generally disk-shaped spacer structure, the spacer rim segments being movable relative to each other in a first direction to deform the central hub portion and selectively enlarge the first cable holder, and the spacer rim segments being movable relative to each other in a second direction opposite to the first direction to deform the central hub portion and selectively enlarge the second cable holder.

According to another broad aspect of the present invention, an insulative spacer apparatus is provided, comprising: a central hub portion having an axis of symmetry and first and second cable holders positioned on opposite sides of the axis, the cable holders each having an open side facing away from the axis; first and second pairs of spokes extending radially outwardly from the first and second cable holders, respectively; and first and second rim segments connected to outer ends of the spokes to form a generally annular structure about the axis of symmetry, the central hub portion being deformable between a first position in which the second cable holder is larger than the first cable holder, a second position in which the first and second cable holders are approximately the same size, and a third position in which the first cable holder is larger than the second cable holder.

Numerous other objects and features of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figure 1:
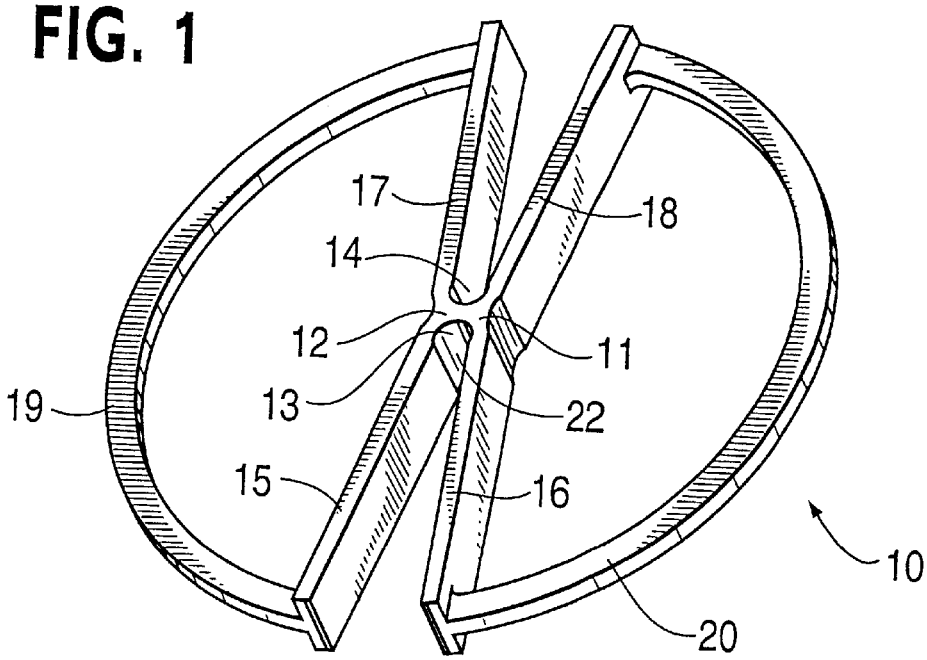
FIG. 1 is a perspective view of the spacer apparatus for a high voltage lead according to the present invention.
Figure 2:
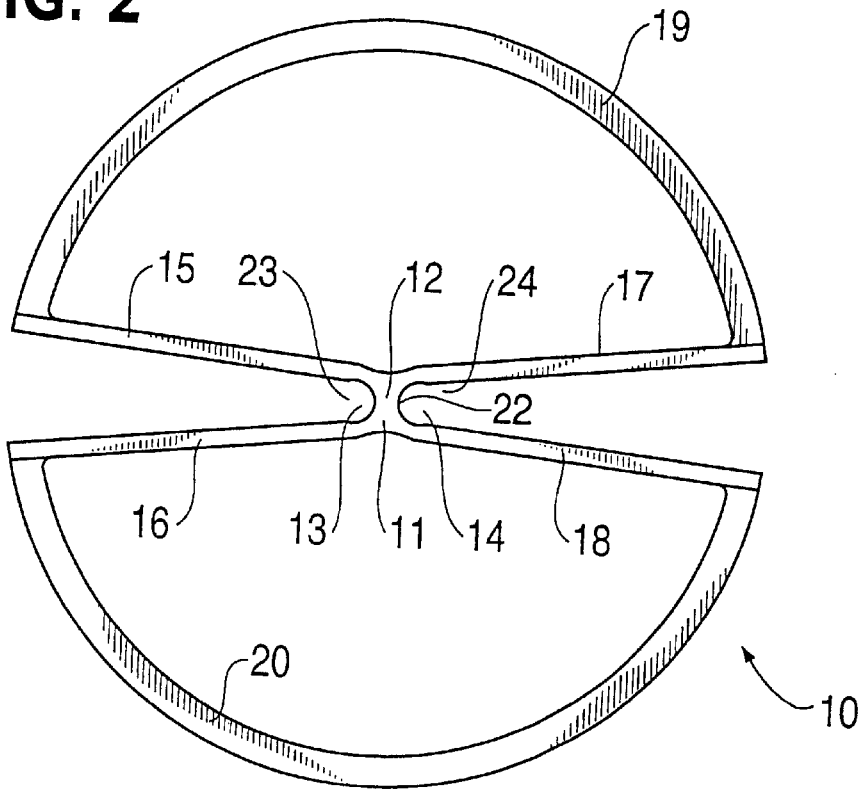
FIG. 2 is a plan view of the high voltage lead spacer apparatus shown in FIG. 1.
Figure 3:
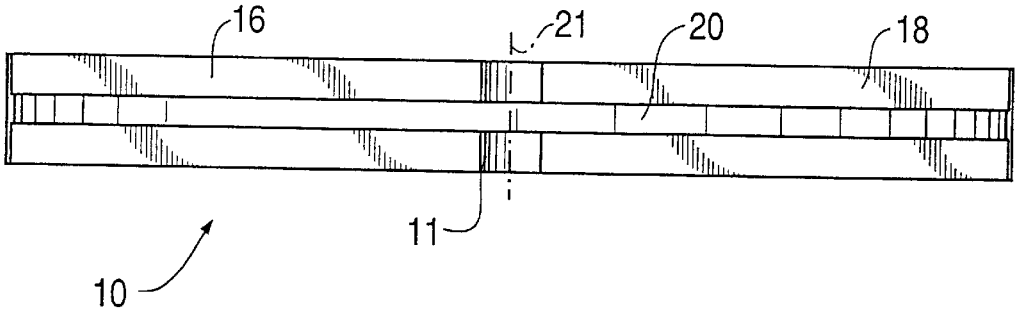
FIG. 3 is a front view of the high voltage lead spacer apparatus shown in FIGS. 1 and 2.
Figure 4:
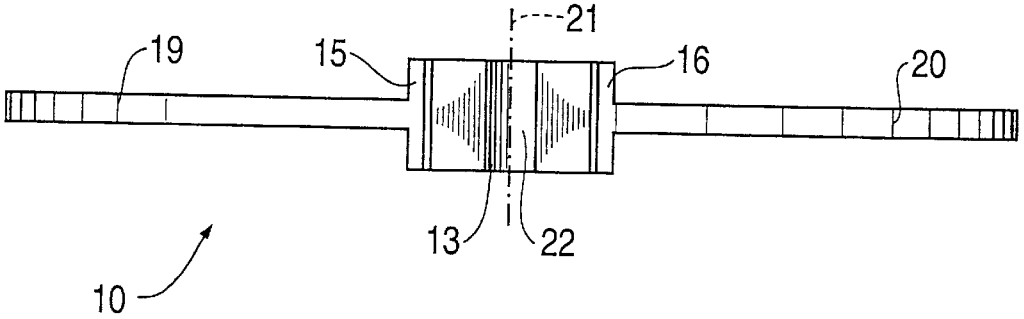
FIG. 4 is a side view of the high voltage lead spacer apparatus shown in FIGS. 1 and 2.

A spacer apparatus 10 for high voltage leads according to the present invention will be described below with reference to FIGS. 1 to 6 of the accompanying drawings.

The spacer apparatus 10 according to the present invention includes a central hub portion 11, which will also be referred to herein as the hub. The hub 11 has a center 12 and first and second holes 13, 14 located on opposite sides of the center 12. A first pair of spokes 15, 16 extend radially outwardly from a first side of the hub 11, and a second pair of spokes 17, 18 extend radially outwardly from a second side of the hub 11. First and second spacer rim segments 19, 20 are connected to the outer ends of the spokes 15–18. The spacer apparatus 10 is symmetrical about the hub center 12.

The holes 13, 14 located on the hub 11 are open-sided bores located on opposite sides of an axis of symmetry 21 of the hub. The holes 13, 14 each have a generally truncated cylindrical configuration with a sidewall 22 that extends approximately 190 to 270 degrees about a circumference of the hole, and preferably about 230 degrees. The open sides 23, 24 of the holes 13, 14 face away from the center 12 of the hub 11 to allow either side of the spacer apparatus 10 to be attached to a high voltage lead 25. The first and second holes 13, 14 provide first and second cable holders, respectively, for attaching to high voltage leads 25.

The first pair of spokes 15, 16 extend radially outwardly from the open side 23 of the first hole 13 of the hub 11. The second pair of spokes 17, 18 extend radially outwardly from the open side 24 of the second hole 14 of the hub 11. In a neutral or at-rest position, the spokes 15, 16 in the first pair of spokes are circumferentially spaced approximately 10 degrees apart from each other, and the spokes 17, 18 in the second pair of spokes are circumferentially spaced approximately 10 degrees apart from each other.

The first and second spacer rim segments 19, 20 together define a generally disk-shaped spacer structure which is concentric with the axis of symmetry 21 through the center 12 of the hub 11. Each spacer rim segment 19, 20 extends approximately 170 degrees about the hub center 12. The first and second spacer rim segments 19, 20 are movable relative to each other, along with the spokes 15–18 on which they are mounted, to deform the hub center 12 and selectively enlarge an open side 23, 24 of one of the holes 13, 14 to facilitate attachment of the spacer apparatus 10 to a high voltage lead 25.

The spacer rim segments 19, 20 and spokes 15–18 are movable using a scissors-like action with the hub center 12 as a fulcrum to selectively enlarge one of the open sides 23, 24 of the holes 13, 14 to facilitate attachment to a high voltage lead 25. The spacer apparatus 10 is symmetrical so that an operator can attach the spacer apparatus 10 to a high voltage lead 25 regardless of the direction in which the apparatus 10 is initially grasped.

Figure 5:
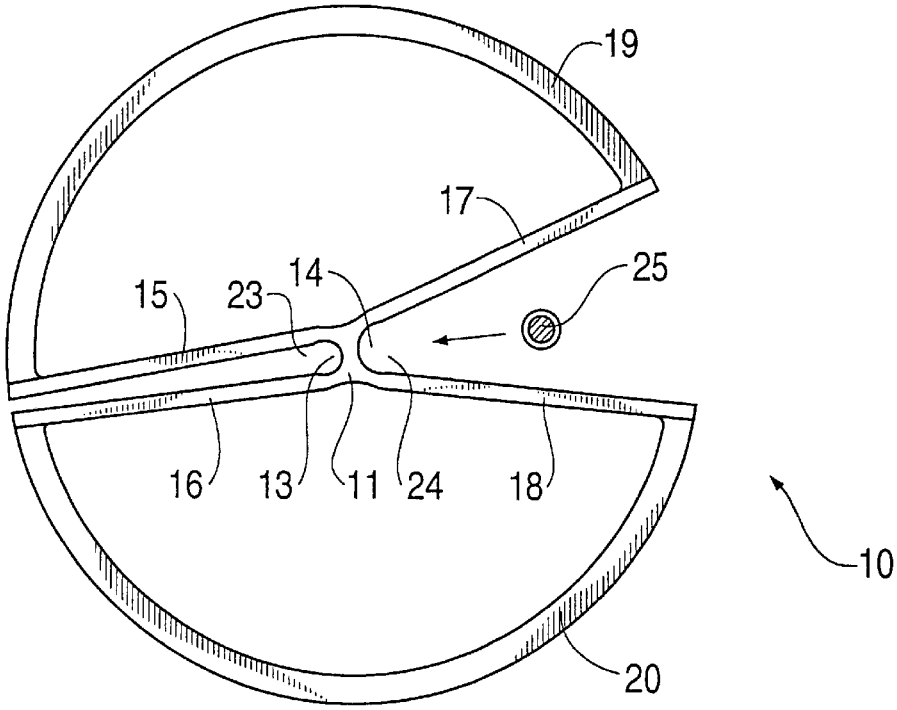
FIG. 5 is a plan view of the high voltage lead spacer apparatus in a deformed position to facilitate attachment to a high voltage lead.
Figure 6:
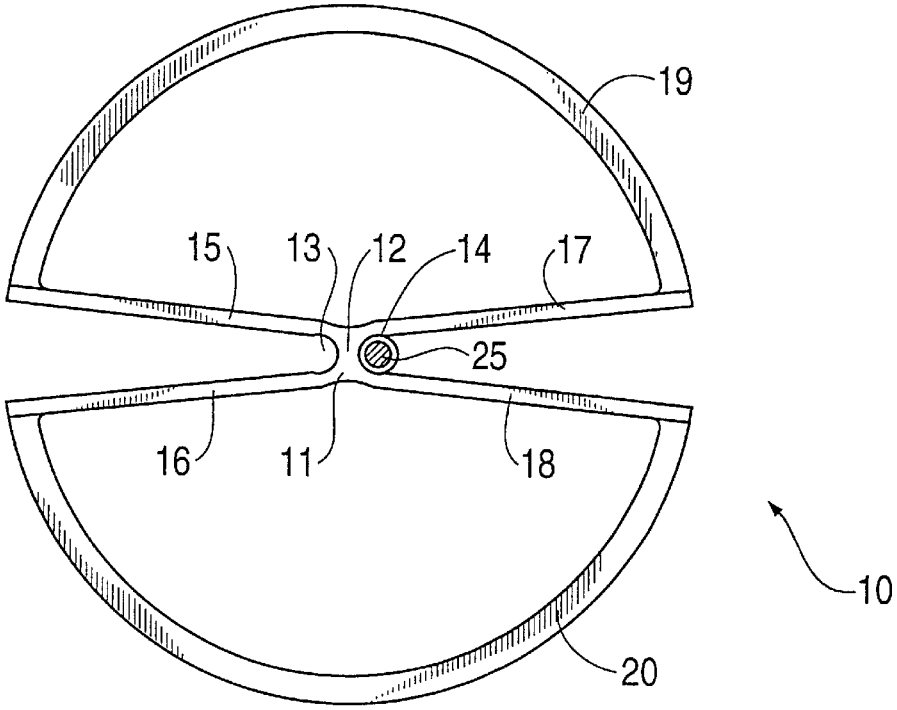
FIG. 6 is a plan view of the high voltage lead spacer apparatus attached to a high voltage lead.

As shown in FIG. 5, the spacer apparatus 10 has a first position in which the outer ends of the first pair of spokes 15, 16 are disposed in close proximity to each other and the open side 24 of the second hole 14 is larger than the open side 23 of the first hole 13. The spacer apparatus 10 is placed in the first position, for example, by an operator pinching the outer ends of the first pair of spokes 15, 16 together using the operator's thumb and index finger of one hand. In this position, the cable holder defined by the enlarged second hole 14 of the spacer apparatus 10 can be placed easily over a high voltage lead 25. Once the high voltage lead 25 is positioned within the second hole 14, the operator releases the pinching force on the first pair of spokes 15, 16 allowing the apparatus 10 to return to its second position shown in FIG. 6 with the spacer apparatus 10 secured tightly to the high voltage lead 25. The spacer apparatus 10 also has a third position (not shown) in which the outer ends of the second pair of spokes 17, 18 are disposed in close proximity to each other, and the open side 23 of the first hole 13 is larger than the open side 24 of the second hole 14.

The first and second holes 13, 14 of the spacer apparatus 10 are preferably sized to accommodate a specific diameter of high voltage lead 25. However, it is contemplated that a single spacer apparatus 10 having the construction of the present invention can be used for a range of diameters of leads due to the resilient nature of the attachment. For example, a single spacer apparatus 10 can be used for lead diameters ranging from about 4.2 mm to about 5.2 mm. The force required to place the spacer apparatus 10 on the lead 25 is substantially reduced as compared to the prior art spacers due to the implementation of a scissors-like action to open the spacer apparatus 10 for attachment.

The hub 11 and spokes 15–18 preferably have a greater thickness in an axial direction than the rim segments 19, 20 to enhance the resiliency, strength and stability of the apparatus 10 when attached to a high voltage lead 25. The rim segments 19, 20 have a greater thickness in a radial direction to enhance the strength and performance of the spacer apparatus 10 in maintaining adequate spacing of the high voltage lead 25 from other components in an electrical device.

The hub 11, spokes 15–18, and spacer rim segments 19, 20 are preferably formed in a single integral piece using a molded, nonconductive material, such as plastic or nylon. The preferred materials allow the hub 11 to be deformed resiliently about its center 12 to facilitate attachment to a high voltage lead 25, and to resume its normal shape to provide a secure and long-term attachment to the high voltage lead 25.

While the invention has been specifically described in connection with specific embodiments thereof, it is to be understood that this is by way of illustration and not of limitation, and the scope of the appended claims should be construed as broadly as the prior art will permit.

What is claimed is:

1. A spacer apparatus for spacing a high voltage lead from other components in an electrical device, comprising:

a hub having a center and first and second holes located on opposite sides of said center, said holes each having an open side facing away from said center for receiving a high voltage lead;

first and second pairs of spokes extending radially outwardly from the respective open sides of said first and second holes of said hub; and first and second spacer rim segments connected to outer ends of said spokes and defining a generally disk-shaped spacer structure concentric with the center of said hub, said first and second spacer rim segments being movable relative to each other to deform the hub center and selectively enlarge one of said open sides to facilitate attachment to a high voltage lead.

2. The spacer apparatus according to claim 1, wherein the spacer apparatus is symmetrical about the hub center.

3. The spacer apparatus according to claim 1, wherein the hub, spokes, and spacer rim segments are formed of a molded, nonconductive material.

4. The spacer apparatus according to claim 1, wherein the spokes in the first pair of spokes are circumferentially spaced approximately 10 degrees apart from each other.

5. The spacer apparatus according to claim 4, wherein the spokes in the second pair of spokes are circumferentially spaced approximately 10 degrees apart from each other.

6. The spacer apparatus according to claim 1, wherein each of said rim segments extends approximately 170 degrees about said hub center.

7. The spacer apparatus according to claim 1, wherein said hub and said spokes have a greater thickness in an axial direction than said rim segments.

8. The spacer apparatus according to claim 1, wherein said hub is made of a molded insulative material which can be deformed resiliently to selectively enlarge the open sides of either of said first and second holes.

9. The spacer apparatus according to claim 1, wherein said apparatus has a first position in which the outer ends of said first pair of spokes are disposed in close proximity to each other and the open side of the second hole is larger than the open side of the first hole, a second position in which the first and second holes are approximately the same size, and a third position in which the outer ends of said second pair of spokes are disposed in close proximity to each other and the open side of the first hole is larger than the open side of the second hole.

10. The spacer apparatus according to claim 1, wherein said apparatus has an axis of symmetry which passes through said hub center, and said first and second holes are on opposite sides of said axis of symmetry.

11. An insulative spacer apparatus, comprising:

a central hub portion having an axis of symmetry and first and second cable holders positioned on opposite sides of said axis, said cable holders each having an open side facing away from said axis;

a plurality of spokes extending radially outwardly from the central hub portion; and first and second spacer rim segments connected to outer ends of said spokes and defining a generally disk-shaped spacer structure, said spacer rim segments being movable relative to each other in a first direction to deform the central hub portion and selectively enlarge said first cable holder, and said spacer rim segments being movable relative to each other in a second direction opposite to said first direction to deform the central hub portion and selectively enlarge said second cable holder.

12. The spacer apparatus according to claim 11, wherein the central hub portion, spokes, and spacer rim segments are formed of a molded, nonconductive material.

13. The spacer apparatus according to claim 11, wherein said central hub portion is made of a molded insulative material which can be deformed resiliently to selectively enlarge either of said cable holders.

14. The spacer apparatus according to claim 11, wherein each of said rim segments is concentric with said axis of symmetry and extends approximately 170 degrees about said axis.

15. The spacer apparatus according to claim 11, wherein said central hub portion and said spokes have a greater thickness in an axial direction than said rim segments.

16. The spacer apparatus according to claim 11, wherein said apparatus has a first position in which the outer ends of a first pair of said spokes are disposed in close proximity to each other and the second cable holder is larger than the first cable holder, a second position in which the first and second cable holders are approximately the same size, and a third position in which a second pair of said spokes are disposed in close proximity to each other and the first cable holder is larger than the second cable holder.

17. An insulative spacer apparatus, comprising:

a central hub portion having an axis of symmetry and first and second cable holders positioned on opposite sides of said axis, said cable holders each having an open side facing away from said axis;

first and second pairs of spokes extending radially outwardly from the first and second cable holders, respectively; and first and second rim segments connected to outer ends of said spokes to form a generally annular structure about said axis of symmetry, said central hub portion being deformable between a first position in which the second cable holder is larger than the first cable holder, a second position in which the first and second cable holders are approximately the same size, and a third position in which the first cable holder is larger than the second cable holder.

18. The spacer apparatus according to claim 17, wherein said central hub portion is movable from said second position to said first position by movement of said rim segments relative to each other in a first direction about said axis, and said central hub portion is movable from said second position to said third position by movement of said rim segments relative to each other in a second direction about said axis which is opposite to said first direction.

19. The spacer apparatus according to claim 17, wherein said central hub portion, said spokes, and said rim segments are integrally formed of a molded, nonconductive material.

20. The spacer apparatus according to claim 17, wherein said first and second cable holders are open-sided bores located on opposite sides of said axis of symmetry, said open-sided bores each having a truncated cylindrical configuration with a sidewall that extends approximately 190 to 270 degrees about a circumference of the bore.

* * * * *